US009138882B2

(12) United States Patent
Martin, Sr.

(10) Patent No.: US 9,138,882 B2
(45) Date of Patent: Sep. 22, 2015

(54) INTERCHANGEABLE HAND TOOL SYSTEM

(71) Applicant: Marvin Carroll Martin, Sr., Southport, NC (US)

(72) Inventor: Marvin Carroll Martin, Sr., Southport, NC (US)

( * ) Notice: Subject to any disclaimer, the term of this patent is extended or adjusted under 35 U.S.C. 154(b) by 276 days.

(21) Appl. No.: 13/734,629

(22) Filed: Jan. 4, 2013

(65) Prior Publication Data

US 2014/0189958 A1 Jul. 10, 2014

(51) Int. Cl.

| | |
|---|---|
| ***B25F 1/02*** | (2006.01) |
| ***B25B 13/46*** | (2006.01) |
| ***B25F 1/00*** | (2006.01) |
| ***B25B 13/58*** | (2006.01) |
| ***B25B 13/00*** | (2006.01) |
| ***B25B 13/12*** | (2006.01) |
| ***B25B 13/14*** | (2006.01) |
| ***B25B 13/56*** | (2006.01) |

(52) U.S. Cl.

CPC ..... *B25F 1/003* (2013.01); *B25B 13/00* (2013.01); *B25B 13/12* (2013.01); *B25B 13/14* (2013.01); *B25B 13/56* (2013.01); *B25B 13/58* (2013.01); *B25F 1/02* (2013.01)

(58) Field of Classification Search

CPC ..... B25F 1/00; B25F 1/003; B25F 1/006; B25F 1/02; B25F 1/04; B25B 13/12; B25B 13/16; B25B 13/48; B25B 13/58; B25B 7/02; B25B 7/04; B25B 7/18; B25B 13/14; B25B 13/46

USPC ..... 7/138, 139, 143, 167, 165; 81/423, 25, 81/180.1, 185.1

See application file for complete search history.

(56) References Cited

U.S. PATENT DOCUMENTS

| | | | | |
|---|---|---|---|---|
| 568,381 | A * | 9/1896 | Thompson | 81/180.1 |
| 753,456 | A * | 3/1904 | Weidiger | 81/423 |
| 3,010,347 | A * | 11/1961 | Kron | 7/139 |
| 5,152,199 | A * | 10/1992 | Lain | 81/180.1 |
| 5,211,085 | A * | 5/1993 | Liou | 81/20 |
| 7,497,150 | B1 * | 3/2009 | Huang | 81/423 |
| 8,915,173 | B2 * | 12/2014 | Clinton | 81/423 |
| 2012/0255401 | A1 * | 10/2012 | Wang et al. | 81/423 |

* cited by examiner

*Primary Examiner* — Hadi Shakeri
(74) *Attorney, Agent, or Firm* — Olive & Olive, P.A.

(57) ABSTRACT

An integrated tool system that includes various interchangeable implements and attachments to provide functionality of pliers, wrenches, hammers, ratchets and screwdrivers. Many of the attachments are secured to rectangular jaws at the upper portion of the device. The lower portion of the device includes an ratcheting gear for accepting sockets, socket adaptors, ratchet extensions and so forth. The upper and lower portions are separable to reveal a receiver for hexes that is stored within the handle, thereby facilitating screwdriving and the like.

7 Claims, 10 Drawing Sheets

INTERCHANGEABLE HAND TOOL SYSTEM

BACKGROUND (1) Field

The present invention relates generally to hand tools, and, more particularly, to a tool system having a core wrench that is capable of receiving a variety of implements and attachments for performing specific manipulations such as gripping, hammering, screwing and ratcheting.

(2) Background of the Invention

Certain hand tools are commonly used and considered part of a standard tool collection found in households, cars, businesses and so forth. Examples of commonly used hand tools include wrenches, pliers, hammers, screwdrivers, hexes, and ratchet sets. With these tools a user can perform a variety of basic manipulations, repairs, improvements, and so forth.

Unfortunately, however, hand tools can be bulky, redundant, and prone to separation from other tools in a collection. As a result, one often has a difficult time finding the right screwdriver, or their hammer, and so forth.

As can be seen, there is a need for an integrated tool system that includes implements and attachments to perform functions of many basic hand tools. It is desirable that this system is relatively compact, simple to use, multi-functional and reduces redundancy of standard tool collections.

SUMMARY OF THE INVENTIONS

The present invention is directed to an integrated tool system that includes various implements and attachments for performing the functions of a variety of basic tools including pliers, wrenches, hammers, ratchets and screwdrivers. Many of the attachments are secured to rectangular jaws at the upper portion of the device. The lower portion of the device includes an ratcheting gear for accepting sockets, socket adaptors, ratchet extensions and so forth. The upper and lower portions are separable to reveal a receiver for hexes that is stored within the handle, thereby facilitating screwdriving and the like. The receiver also strengthens the structure of the device, thereby allowing greater leverage.

These and other aspects of the present inventions will become apparent to those skilled in the art after a reading of the following description of the preferred embodiment when considered with the drawings.

DESCRIPTION OF THE PREFERRED EMBODIMENTS

Figure 1:
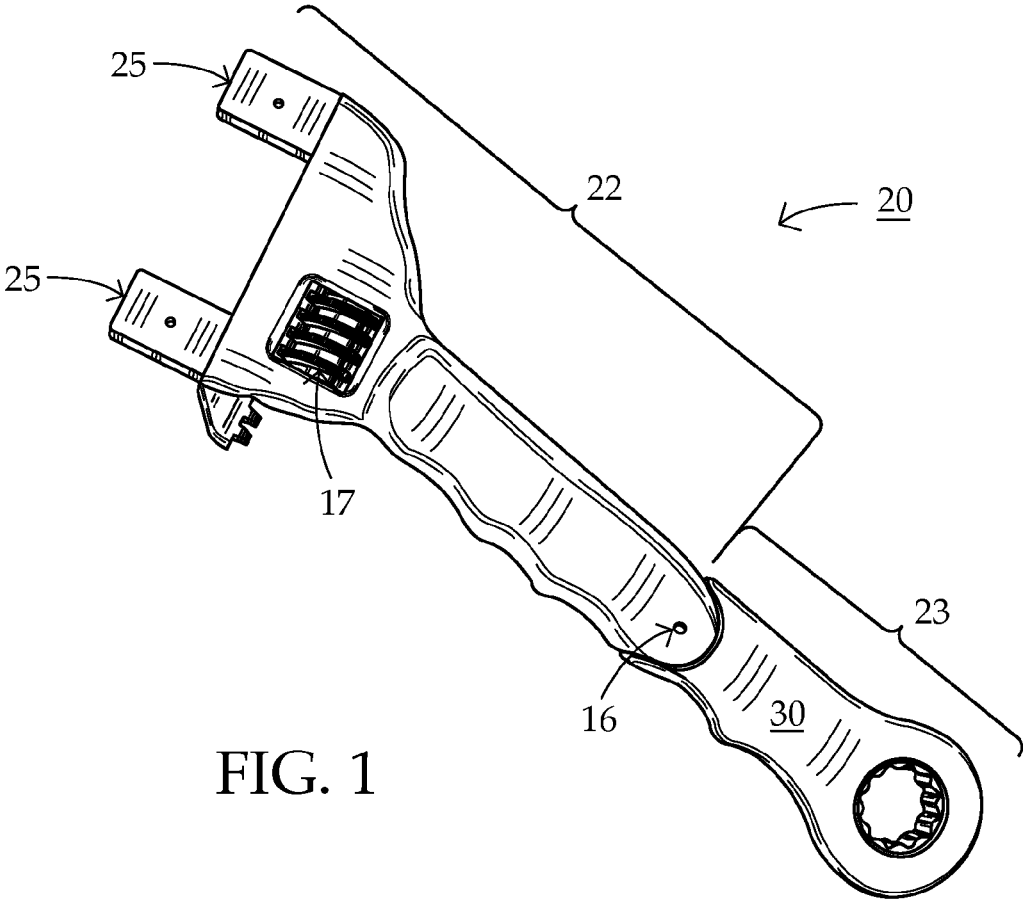
FIG. 1 is a perspective view of a core wrench.

In the following description, like reference characters designate like or corresponding parts throughout the several views.

The following structures are among the various FIGS:

10—tool;
12—set screw;
13—set screw aperture;
14—set screw indentation;
15—ball plunger;
16—ball plunger aperture;
17—worm screw;
20—core wrench;
21—grip;
22—upper portion;
23—lower portion;
25—jaws;
27—reinforced walls;
28—channel;
30—removable handle;
32—receiver;
33—sleeve;
35—hex;
40—ratcheting gear;
42—socket adapter;
43—socket;
50—attachment;
51—hammer attachment;
52—planar edge wrench attachment;
53—modified planar edge wrench attachment;
54—angled edge wrench attachment;
55—modified angled edge wrench attachment;
56—needle nose pliers attachment;
57—serrated edge wrench attachment;
58—grasping implement;
60—attachment slot;
62—side slot;
65—extender;
67—ratchet extension; and
68—open-end wrench extension.

Referring now to the drawings in general and FIG. 1 in particular, it will be understood that the illustrations are for the purpose of describing preferred embodiments, and are not intended to limit the inventions thereto. As best seen in FIG. 1, core wrench 20 is generally divided into upper portion 22 and lower portion 23, with distal end of upper portion 22 having two opposable jaws 25, and the proximal end of upper portion 22 slidably engaging with the proximal end of lower portion 23. The distal end of lower portion 23 defines rotating ratcheting gear 40, and is generally surrounded by handle 30.

Worm screw 17 moves one opposable jaw 25 relative to the other, while the other opposable jaw 25 is immovable, as is familiar in crescent wrenches. However, unlike a conventional crescent wrench, the jaws of the present invention are substantially rectangular in shape, not semi-circular. It has been determined that the rectangular shape lends itself to more secure connections to attachments and implements.

Figure 1A:
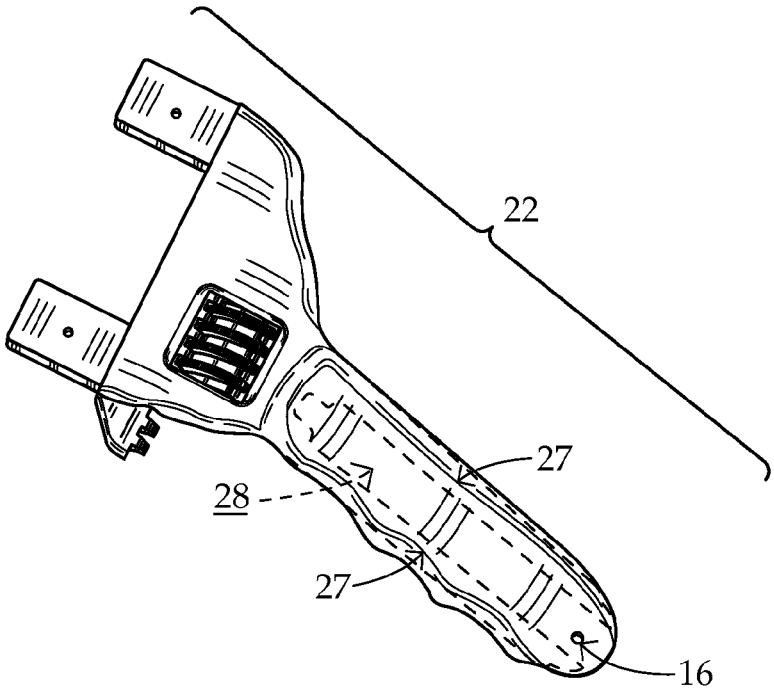
FIG. 1A is a view of a core wrench with internal reinforced walls shown in phantom.
Figure 7:
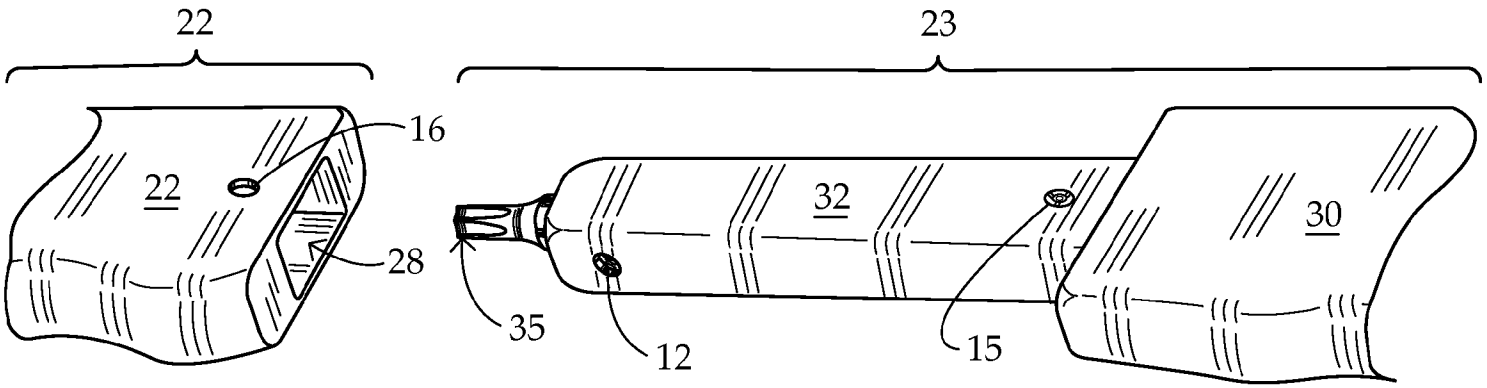
FIG. 7 depicts a perspective view of a removable handle disengaged from a core wrench.

FIG. 1A depicts inner structure of upper portion 22, with two reinforced walls 27 (shown in phantom) running longitudinally along the edges of the proximal end, thereby defining channel 28. As used herein, "reinforced" refers to providing greater strength due to thickness, material and/or other features. As best shown in FIG. 7, receiver 32 of lower portion 23 slides into channel 28 of upper portion 22. This design strengthens the tool, keeps the receiver portion out of the way when not in use, and provides a readily available means for screwing and unscrewing set screws of the device.

Figure 2:
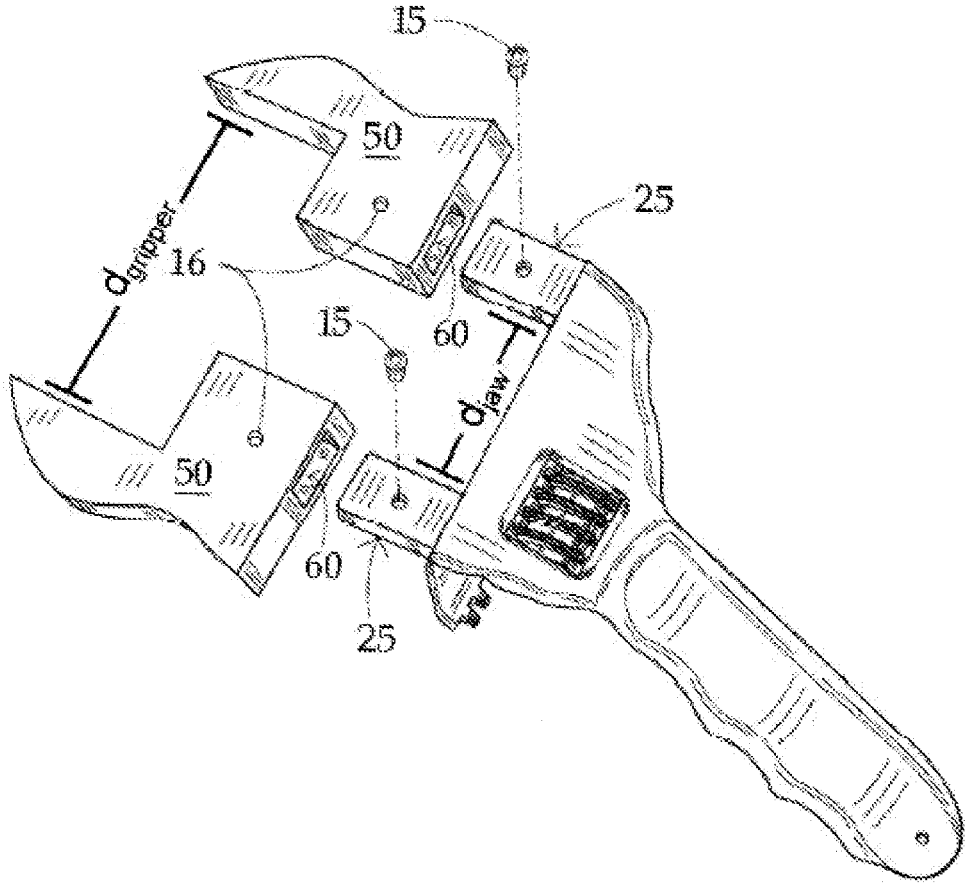
FIG. 2 is a perspective view of a core wrench with a set of attachments in position for engagement with wrench jaws.
Figure 4:
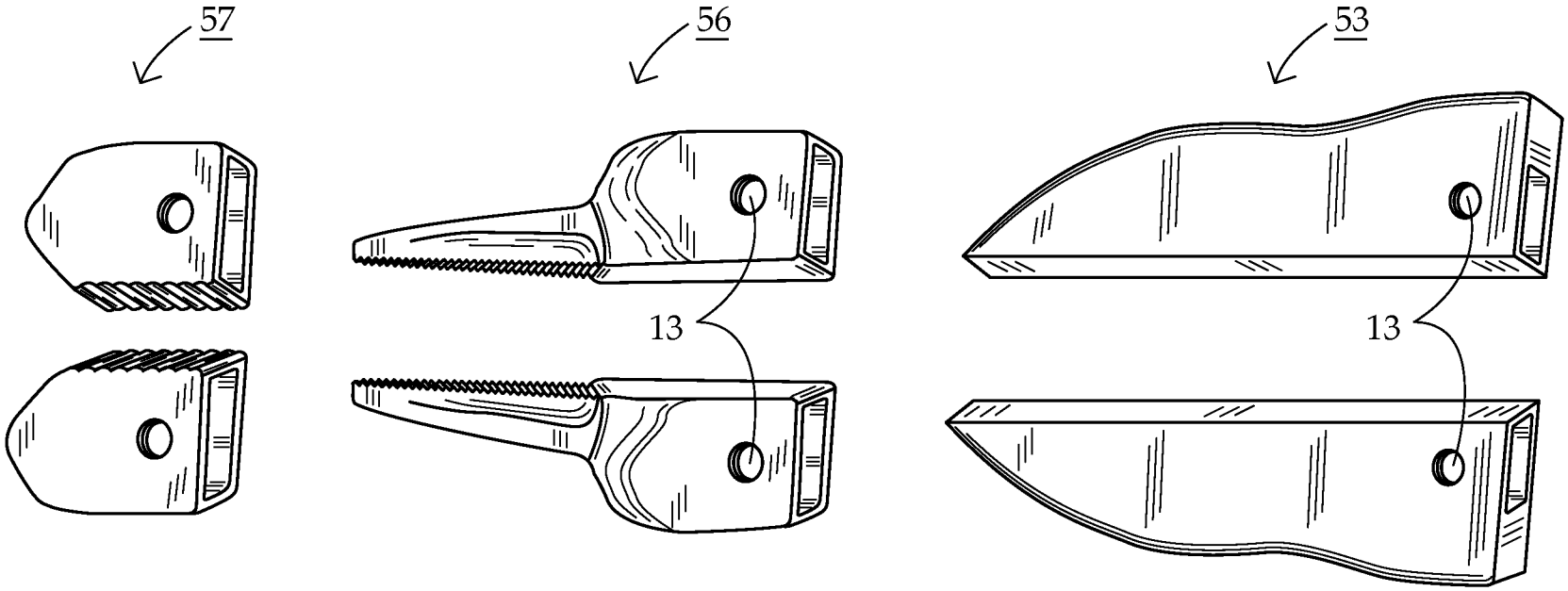
FIG. 4 depicts multiple sets of attachments.
Figure 5:
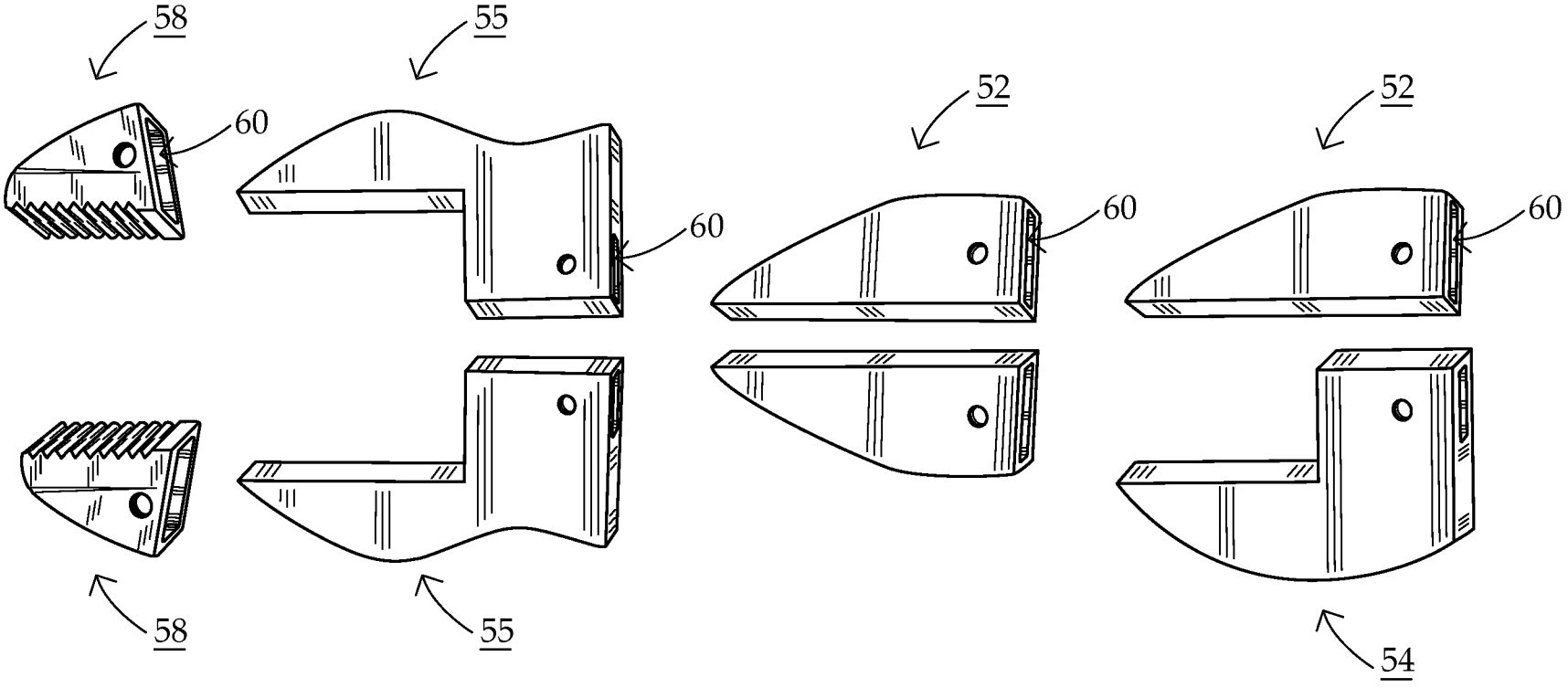
FIG. 5 depicts multiple sets of attachments.

As shown in FIG. 2, attachment slot 60 of attachment 50 is sized to snugly fit over jaw 25, so as to virtually eliminate unwanted lateral movement and be frictionally held in place prior to securing. Attachment 50 can be a variety of sizes and shapes, with preferred embodiments shown in FIGS. 4 and 5. More specifically, preferred embodiments include modified planar edge wrench attachment 53; needle nose pliers attachment 56; serrated edge wrench attachment 57; angled edge wrench attachment 54; planar edge wrench attachment 52; modified angled edge wrench attachment 55; and grasping implement 58. As shown in FIG. 5, it is possible to use dissimilar attachments. As an example, planar edge wrench attachment 52 and angled edge wrench attachment 54 are shown together. As would be understood, different attachments perform different function. For example, two angled edge wrench attachments 54 would provide the functionality of a wrench having a very wide span, approximately 3" while serrated edge wrench attachment 57 would be particularly useful for gripping smooth cylindrical pipes. Grasping implement 58 is sized to fit over the tips of various attachments, for example modified angled edge wrench attachment 55, and provide gripping action at the tip as needed.

Figure 6:
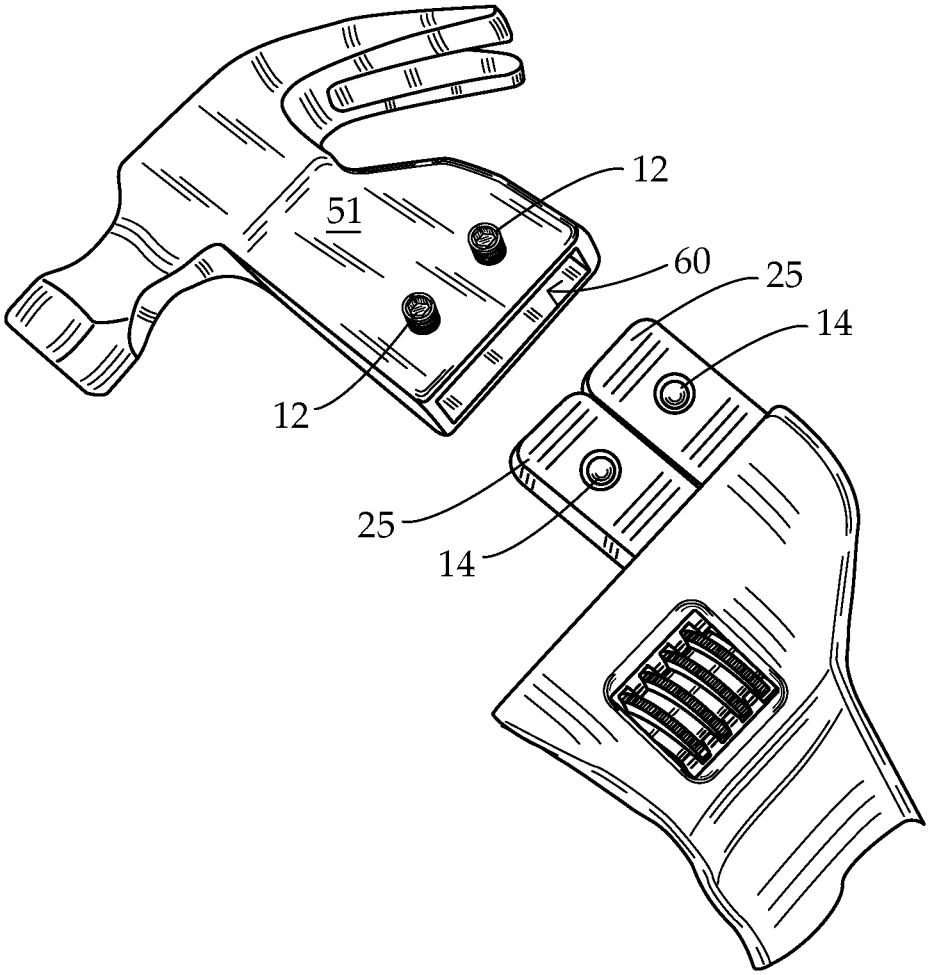
FIG. 6 is a perspective view of a core wrench with a hammer attachment in position for engagement with wrench jaws.

Referring back to FIG. 2, attachment 50 may be secured to jaw 25 by ball plunger 15, which is embedded in jaw 25 and protrudes through ball plunger aperture 16. Alternatively, as shown in FIG. 6, set screws 12 may traverse attachment (here, hammer 51) through set screw aperture 13 (shown in FIG. 4), and screw into set screw indentation 14. It is preferred to provide both the ball plunger and corresponding ball plunger aperture 15, 16, as well as the set screw, set screw aperture and set screw indentation 12, 13, 14 options for each attachment. In other words, it is preferred that each jaw 25 has ball plunger 15 on one side, and set screw indentation 14 on the other side, and each attachment 50 has ball plunger aperture 16 on one side, and set screw aperture 13 on the other side. Thus a user can use a set screw and/or ball plunger to fasten attachment 50 to core wrench 20, although set screws only may be preferable for hammer attachment 51 for safety reasons.

As shown in FIG. 6, attachment slot 60 of hammer attachment 51 is sized to accept both jaws 25 simultaneously and in side-by-side orientation. It should be noted that hammer attachment 51 can be reversed, for example striking surface oriented right and prying surface oriented left, depending on intended use.

Figure 8:
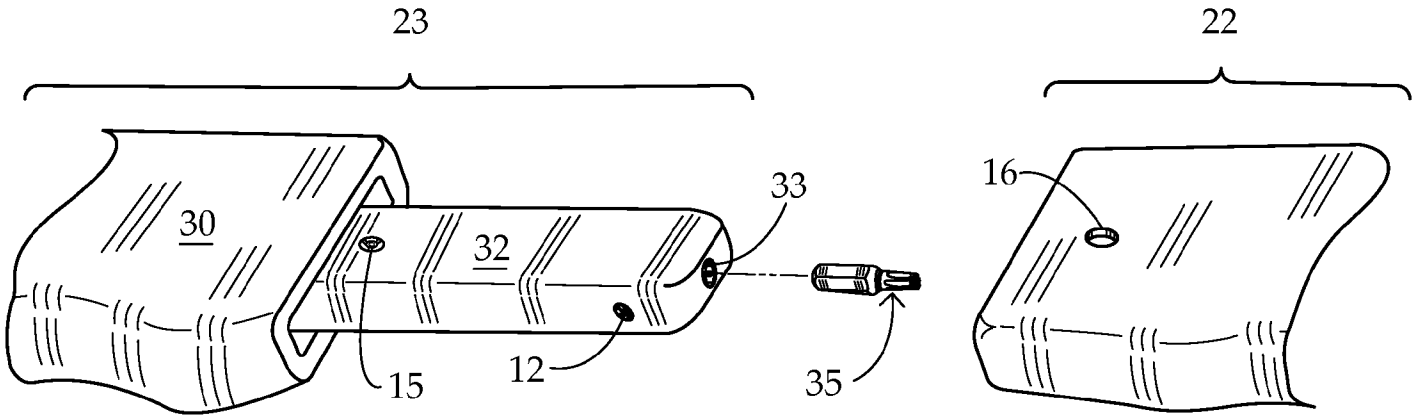
FIG. 8 depicts a perspective view of a disengaged removable handle with a disengaged hex.

FIGS. 7 and 8 depict connection between upper portion 22 and lower portion 23, with lower portion 23 sliding into upper portion 22. Connection between portions is preferably achieved by ball plunger 15 and ball plunger aperture 16. It should be understood that the separable handle is also useful insofar as it is possible to use the device with a shortened handle, for example that depicted in FIG. 1A. A shortened handle could be useful in a limited workspace. As shown, hex 35 is received into sleeve 33 of receiver 32, and secured by set screw 12. It should be understood that hex 35 can be a variety of tool bits such screw drivers, scrapers, chisels, borers, and the like.

Figure 3:
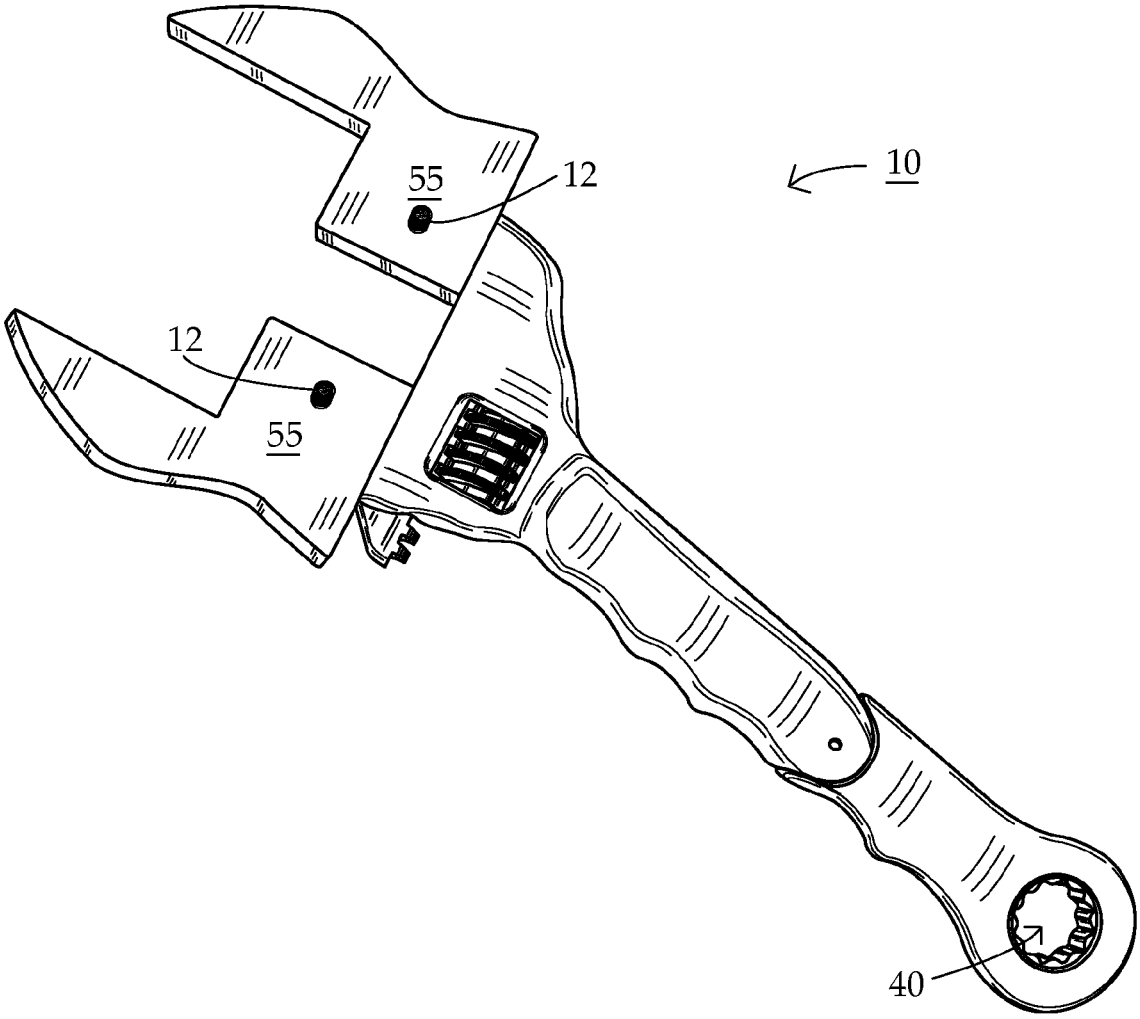
FIG. 3 is a view of a core wrench with a set of attachments engaged.
Figure 9:
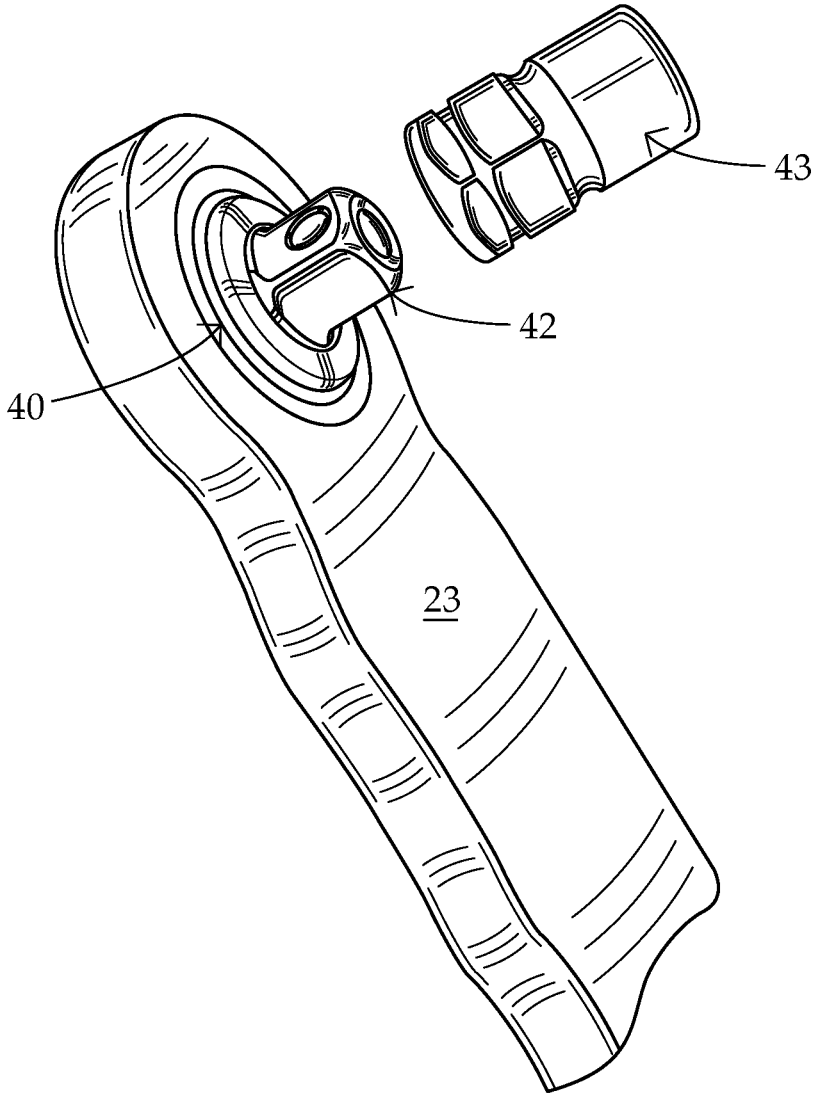
FIG. 9 depicts a perspective view of a ratchet wrench integrated with the removable handle, including a socket adaptor and socket.

The distal end of lower portion 23 defines ratcheting gear 40, see FIG. 3. As shown in FIG. 9, ratcheting gear 40 is capable of securely receiving socket adaptor 42, which can receive, for example, socket 43. As is understood by those in the art, socket adaptors and sockets can be connected in a myriad of ways to achieve ratcheting capability that ranges from very small to very large diameter heads.

Figure 10:
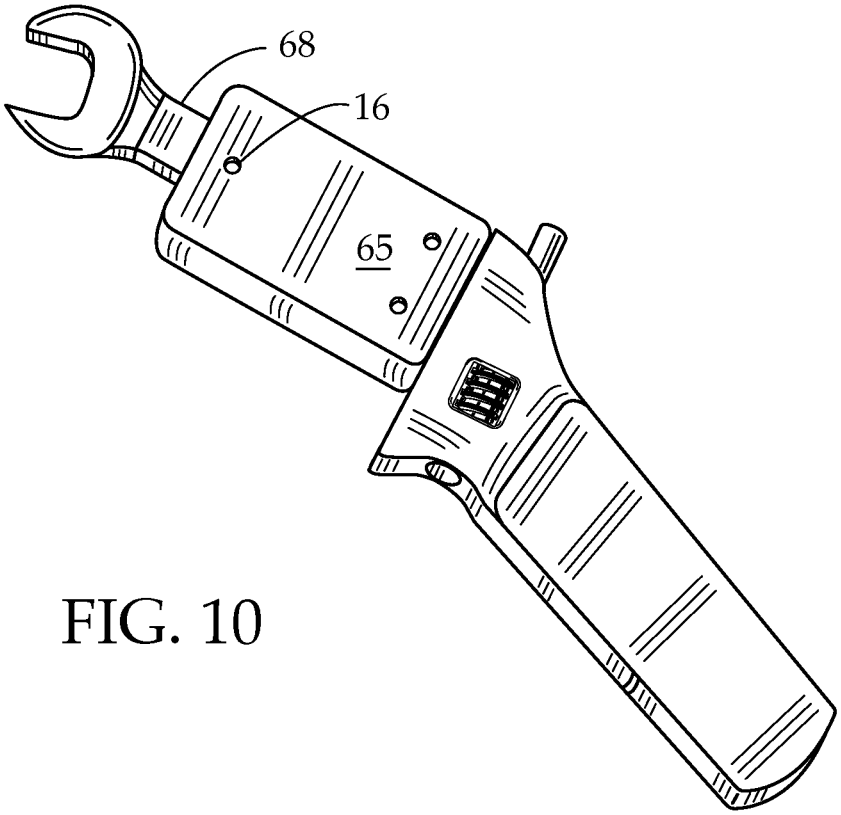
FIG. 10 depicts an extender and several usages thereof.
Figure 10A:
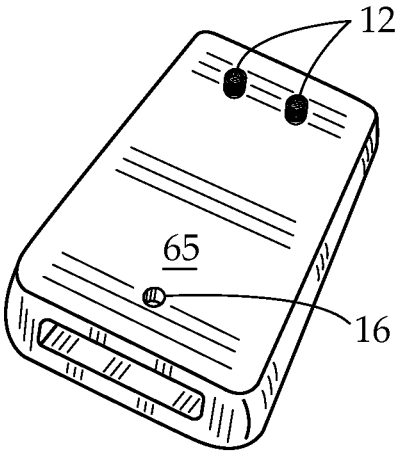
FIG. 10A depicts an extender.
Figure 10B:
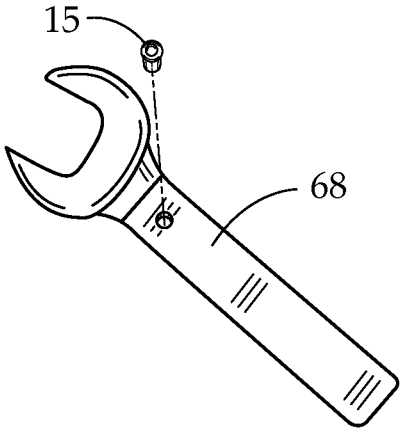
FIG. 10B depicts an open-end wrench extension.

Another implement of the present invention, depicted in FIG. 10, is extender 65, which slips over side-by-side oriented jaws and provides leverage for securing open-end wrench extension 68. It should be understood that open-end wrench extension 68 is depicted, but various tools, for example a box wrench, particularly those with elongated handles, could be used with extender 65. In the embodiment depicted in FIG. 10, extender 65 defines ball plunger aperture 16, and would therefore have ball plunger 15 underneath on open-end wrench extension 68. Alternatively, extender 65 could retain ball plunger 15, with ball plunger aperture 16 defined by open-end wrench extension 68. This could be useful where tool, for example open-end wrench extension 68, has a thin elongated portion, and is incapable of retaining a ball plunger.

Figure 11:
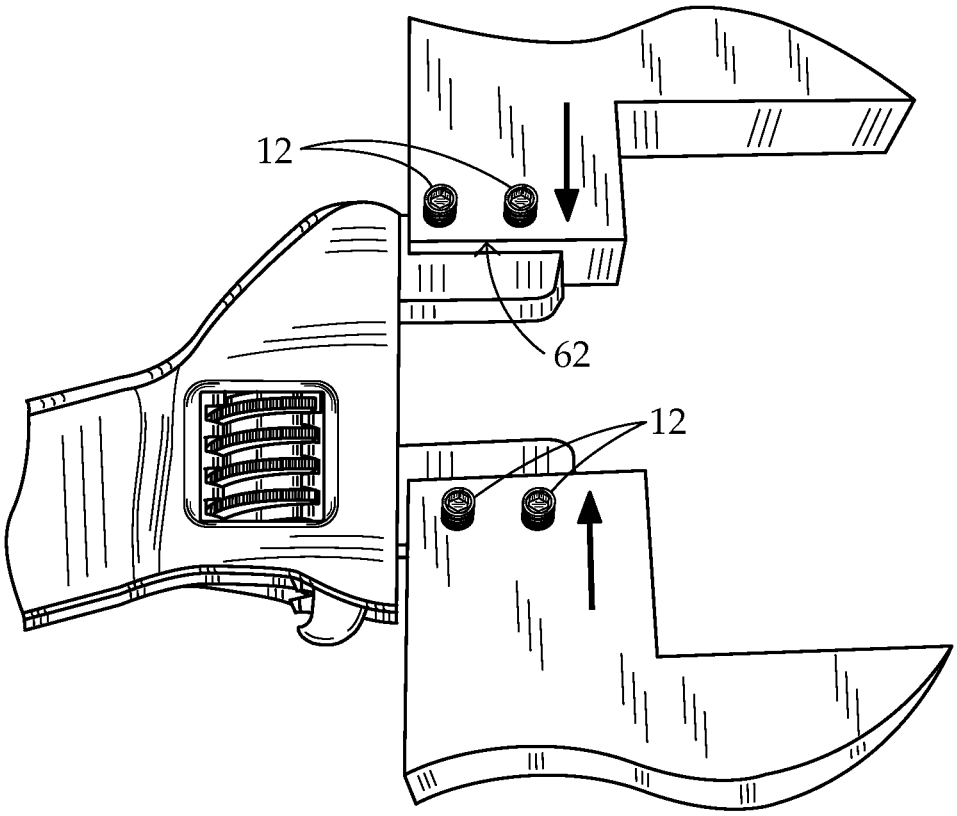
FIG. 11 depicts an alternate embodiment of an attachment.

An alternative embodiment is depicted in FIG. 11, wherein attachment defines side slot 62 (having 4 slot walls), versus attachment slot 60 (having 5 slot walls). In this embodiment it is desirable to have dual set screws 12, and not employ ball plungers.

Although the dimensions of present invention could be varied, the following approximate dimensions are preferred: length of upper portion 22 is 3"; length of lower portion 23 is 3"; exposed portion of jaws 25 are each 1.2" tall, 0.75" wide, and ⅜" thick; maximum clearance between jaws 25 is 1⅜"; diameter of ratcheting gear 40 is sized to receive a ¾" hex, or a 6, 8 or 12 point bolt or nut. An example of a suitable ¾" hex is commercially available from Kobalt Manufacturing. Dimensions of reinforced walls 27 are thicker than adjoining walls, and are about 0.45" thick; sleeve 33 is sized to receive ¼" hex; and channel 28 is 3" deep, 0.40" tall and 0.60" wide. Slots 60 are sized to snugly receive jaws 25. It is desirable to use Press-Fit stainless steel body spring plunger with stainless steel balls, 25" body diameter, 1.5-3.5 lb nose force ball plungers which are commercially available from McMaster-Carr of Atlanta, Ga. It is desirable that the present invention is manufactured out of true steel, carbon steel, stainless steel, brass, plastic, aluminum, and/or titanium.

In use, one could select appropriate attachments 50, and insert jaws 25 into attachment slots 60. Attachments 50 could be secured using set screw 12, ball plunger 15, or both. Removable handle 30 could be pulled from upper portion 22 to expose receiver 32 with hex 35 if needed to tighten set screws 12, if needed. Removable handle 30 could then be slideably engaged with upper portion 22, thereby returning tool 10 to useable configuration. Worm screw 17 could be adjusted to achieve desired span of attachment 50, and desired manipulations could be performed. Grasping implement 58 could be added to attachment 50 if slippage is a concern. If hammering action is desired, jaws 25 could be brought to side-by-side position using worm screw 17, and hammer attachment 51 would be connected, preferably using set screws 12. If an open-end wrench is needed, one could connect extender 65 to side-by-side jaws 35, and add extension 68, or the like. If ratcheting action is desired, one could insert socket 43 and/or socket adapter 42 into ratcheting gear 40 and use.

Certain modifications and improvements will occur to those skilled in the art upon a reading of the foregoing description. By way of example, the length of the handle, jaws, and so forth could be varied. The device can include a ruler or other length measuring demarcation. Also, additional attachments could be used. Set screws, ball plunger and corresponding attachment sites can be located differently as shown. Also, it is possible to paint or otherwise coat the invention for longevity or aesthetic reasons. It should be understood that all such modifications and improvements have been deleted herein for the sake of conciseness and readability but are properly within the scope of the following claims. Ranges set forth herein include all increments there between, and approximations are +/−5%.

I claim:

1. An interchangeable wrench system including:

a) a core tool including a first jaw and a second jaw, said jaws substantially rectangular and opposable, wherein said first and said second jaws are separated one from another by a first distance;

b) a first attachment defining a first attachment slot, said first attachment slot engageable with said first jaw;

c) a first securing means for fastening said first jaw to said first attachment;

d) a second attachment defining a second attachment slot, said second attachment slot engageable with said second jaw, wherein said first and second attachments are separated one from another by a second distance; and e) a third attachment defining a third attachment slot, said third attachment slot engageable with said first jaw and said second jaw simultaneously, wherein said core tool is capable of engagement at a given time with attachment combinations selected from the group consisting of first attachment only, second attachment only, first and second attachment only; and third attachment only.

2. The interchangeable tool system of claim 1 wherein said third attachment is selected from the group consisting of a hammer attachment and an extender.

3. The interchangeable tool system of claim 1 wherein said first securing means is selected from a set screw and a ball plunger.

4. The interchangeable tool system of claim 1 wherein said first attachment slot includes 5 walls.

5. The interchangeable tool system of claim 1 wherein said first attachment slot includes 4 walls.

6. The interchangeable tool system of claim 1 wherein said core tool further includes a worm screw, said first jaw is moveable by said worm screw.

7. The interchangeable tool system of claim 1 wherein said second distance is greater than said first distance.

* * * * *